United States Patent [19]

Garner et al.

[11] 3,943,885

[45] Mar. 16, 1976

[54] ADHESIVE APPLYING ARRANGEMENT FOR THE INSOLES OF SHOES

[75] Inventors: Derek H. Garner, Leicester; Robert C. Quarmby, Groby, both of England

[73] Assignee: USM Corporation, Boston, Mass.

[22] Filed: Feb. 20, 1975

[21] Appl. No.: 551,284

[52] U.S. Cl. ..... 118/411

[51] Int. Cl.[2] ..... B05C 5/02

[58] Field of Search ..... 118/410, 411, 412

[56] References Cited

UNITED STATES PATENTS

| | | | |
|---|---|---|---|
| 3,422,797 | 1/1969 | Becker | 118/411 |
| 3,570,454 | 3/1971 | Barton | 118/411 |
| 3,840,929 | 10/1974 | Garner et al. | 118/411 X |

*Primary Examiner*—John P. McIntosh
*Attorney, Agent, or Firm*—Donald N. Halgren; Vincent A. White; Richard B. Megley

[57] ABSTRACT

An arrangement for applying adhesive to insoles of shoes in a lasting operation comprising a U-shaped applicator having passages therethrough for extruding cement upon the insole. An array of criss-crossed channels drain surplus adhesive from the extrusion arrangement. The extrusion arrangement includes V-shaped grooves which apply the adhesive to the insole.

5 Claims, 3 Drawing Figures

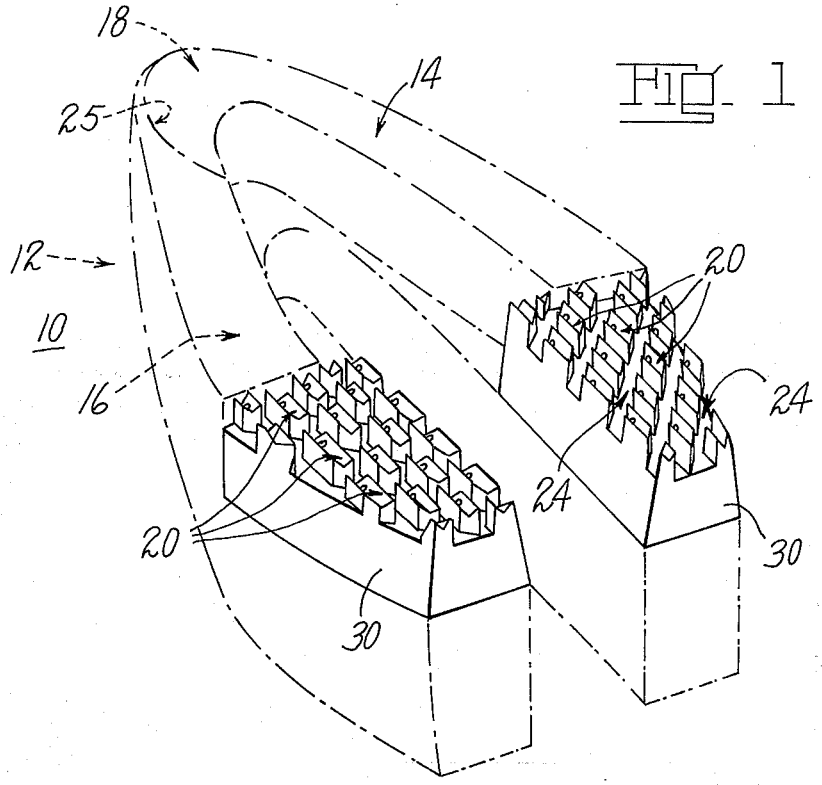
FIG. 1
FIG. 2
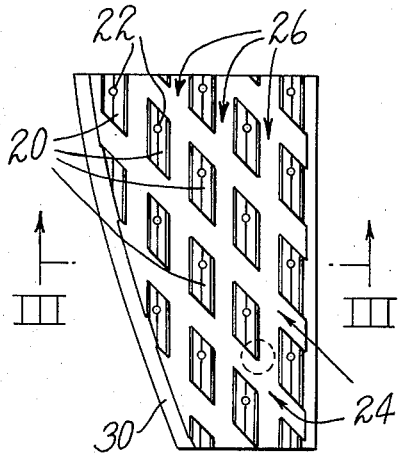
FIG. 3
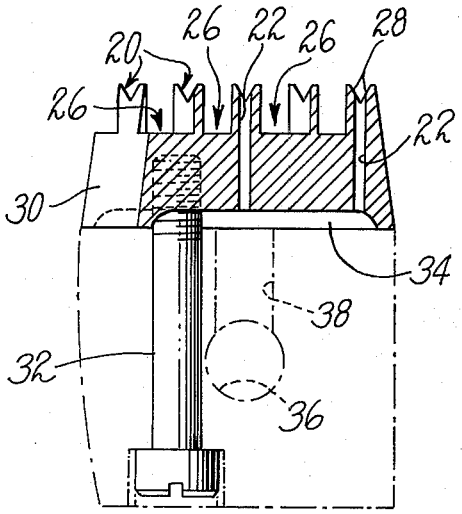

ADHESIVE APPLYING ARRANGEMENT FOR THE INSOLES OF SHOES

BACKGROUND OF THE INVENTION

1. Field of Invention

This invention relates generally to shoe lasting machines, and, more particularly, to adhesive extrusion arrangements for applying adhesive to shoe bottoms.

2. Prior Art

Machines for lasting end portions of shoe uppers such as toe lasting machines and heel lasting machines generally have some sort of adhesive applying devices. Such devices are usually arranged to apply adhesive in fluid condition to marginal portions of insoles positioned on the bottom of lasts so that marginal portions of the shoe uppers on the lasts may be wiped inwardly over the last bottom and secured to the insoles.

An example of an adhesive applying device suitable for use in a toe lasting machine is disclosed in U.S. Pat. No. 3,422,797 and assigned to the assignee of the present application. As disclosed, the device includes a generally U-shaped nozzle member having a surface provided with a groove extended therearound. Means are provided for engaging the surface with the bottom face of an insole of a shoe assembly on a last supported in the machine so that adhesive extruded through the groove may be applied to marginal portions of the insole.

Another example of an adhesive applying device is that shown in FIGS. 4 and 5 of U.S. Pat. No. 3,840,929, and also assigned to the assignee of the present invention. The arrangement shows a U-shaped plate having a knurled appearance which is provided by a waffle iron-like series of generally orthogonal V-shaped grooves forming frusto-pyramids between the grooves and an array of ports for extruding adhesive onto an insole.

Yet another arrangement for applying adhesive to an end of an insole is shown in U.S. Pat. No. 3,570,454 and assigned to the assignee of the present invention. The device extrudes adhesive out of a groove that is capable of being adjusted to accommodate a variety of shoe sizes.

As adhesive applying members of much of the prior art apply adhesive for example to the bottom of a left shoe, an outer portion of the heelward end portion of the adhesive applying member may not be completely covered by the shoe bottom. Adhesive on the exposed portion of the applying member will therefore not be applied to the shoe bottom and, unless it drains or is cleaned away quickly, may result in a buildup of adhesive in this region with the possibility that the excess adhesive may find its way between the upper and last beyond the edge of the bottom of the next shoe.

Accordingly, it is a general object of the invention to provide an adhesive nozzle applying arrangement that is simple to manufacture and has improved characteristics over the prior art, such as improved drainage of surplus adhesive from the nozzle area. Inasmuch as any one particular insole disposed upon the adhesive applying member may not cover up, contourwise, the entire area of the nozzle member, whether due to style, size, left or right of the particular shoe or whatever, surplus adhesive will be permitted to drain away and not harm the upper or clog the nozzle arrangement with excess adhesive that would otherwise have been applied to the insole.

The illustrative adhesive applying member is suitable for use in a pulling over and toe lasting machine generally similar to the machine described in copending U.S. application Ser. No. 433,207 filed Jan. 14, 1974, now abandoned.

SUMMARY OF THE INVENTION

The present invention is an adhesive applying member suitable for use in a shoe lasting machine. The member comprises a body portion having a substantially U-shaped insole-confronting surface comprising arm portions corresponding to marginal portions of a forepart region of a shoe bottom and a toe end portion corresponding to marginal portions of a toe end portion of a shoe bottom. The heelward end region of each arm is provided with a plurality of V-shaped grooves extending generally lengthwise of a shoe, to which grooves adhesive is supplied by openings into said grooves, the grooves being interrupted by crosswise extending channels, deeper than the grooves, and being separated in a direction extending widthwise of the shoe by other channels extending lengthwise of the shoe, whereby surplus adhesive may readily drain away from the V-shaped grooves.

The invention also provides support means for supporting in said machine a shoe comprising an insole positined on the bottom of a last within an upper, as well as means for applying adhesive in liquid form to marginal portions of an insole.

DESCRIPTION OF THE DRAWINGS

The above objects and advantages of the invention will become more readily apparent when viewed in conjunction with the following drawings, in which:

FIG. 1 is a perspective view of an adhesive applying member constructed in accordance with the principles of the present invention;

FIG. 2 is a plan view of a portion of the applying member; and

FIG. 3 is a view taken along the lines III-III of FIG. 2.

DESCRIPTION OF THE PREFERRED EMBODIMENT

Referring now to the drawings and particularly to FIG. 1, there is shown in a preferred embodiment an adhesive applying member 10 for use with a shoe upper conforming machine. The adhesive applying member 10 may be utilized to apply a liquid cement such as a thermoplastic adhesive in molten condition to marginal portions of an insole of a shoe, not shown. The shoe (as referred to herein) typically comprises an upper and an insole assembled on a last, the upper being tensioned about the last, the adhesive being applied to the insole before the marginal portions of the upper are wiped inwardly with respect to marginal portions of the insole. The illustrative adhesive applying arrangement is generally similar, except as hereinafter described, to the adhesive applying arrangement disclosed in U.S. Pat. No. 3,840,929 and modified as disclosed in another copending application, U.S. Ser. No. 433,207.

The adhesive applying member 10 comprises a body portion 12, indicated in dot-dash lines in FIG. 1, having a substantially U-shaped or horseshoe-shaped body portion having arm shaped insole confronting surfaces 14 and 16 corresponding to marginal portions of a forepart region of an insole, and a toe end portion 18 corresponding to marginal portions of a toe end portion of an insole. It is to be noted that the adhesive applying member 10 could be used to apply adhesive to a heel portion of the shoe bottom but in this embodiment only the toe end of a shoe bottom will be described. Each of the arm portions 14 and 16 comprises a heelward end region provided with a plurality of V-shaped grooves 20 extending generally lengthwise of the shoe with adhesive being supplied to the grooves by openings 22. The V-shaped grooves 20 are interrupted by crosswise extending channels 24, deeper than the grooves and are separated in a direction extending widthwise of the shoe by an array of channels 26 extending generally lengthwise of the shoe, whereby surplus adhesive may readily drain away from the V-shaped grooves 20.

Typically, the V-shaped grooves 20 may be about 0.6 to 0.7 cm. long and may be formed by generally planar faces 28, as shown in FIG. 3, having an included angle of about 60° at the base of each groove 20. The width of the grooves 20 typically is about 0.24 cm. The lengthwise extending channels 26 may be one-fourth of a cm. wide and the crosswise extending channels 24 may be of generally similar width and may be inclined at an angle of about 45°, as seen in FIG. 2, to the lengthwise direction of a shoe supported on the adhesive applying member 10. The channels 24 and 26 generally may be about 0.4 cm. deep. The heelward end portions of the arm portions 14 and 16 may be unitary with the toeward ends or may comprise separate metal blocks, preferably steel, and may be secured to the remaining portions of the arms 14 and 16 by an arrangement of bolts 32, only one being shown in the drawings. The grooves 20 and channels 24 and 26 preferably are formed by machining operations in the blocks 30. If the adhesive applying member 10 is to be used in a machine as disclosed in said application Ser. No. 433,207, it may comprise two nozzle members, one supplying adhesive to arm portion 14 and the other supplying adhesive to the second arm portion 16 together with the toe end portion 18. The two nozzle members may be hingedly connected at the toe end portion 18 by a knuckle joint 25, as shown in FIG. 1 of said application, permitting opening and closing movements widthwise with respect to a shoe confronted by the adhesive applying member 10.

The openings 22 are provided by fine bores in each block 30 which lead from a recess 34 in the underside of each block 30. The recess 34 is closed by an opposed surface formed at the upper side of the associated arm portion 14 or 16, to which the block 30 is bolted. An adhesive supplying passage 36 extending through the body portion of each arm 14 and 16 has a passage 38 leading therefrom into the recess 34. Hence, when adhesive in liquid or molten condition is fed through the supplying passage 36, it will pass into the passages 38, and then into the recess 34, and finally be extruded out the openings 22 into the several V-shaped grooves 20. The means for supplying adhesive to the adhesive applying member 10 may be arranged by feeding thermoplastic adhesive, in rod form, to passageways on heating blocks. Molten adhesive in this manner is forced out of the passageways in the heating blocks and extruded, after going through the appropriate aforementioned passageways, through outlet openings in the insole-confronting portions of the adhesive applying member to flood those portions with adhesive ready for application to the insole.

Thus, it is seen from the above description that the V-shaped grooves 20 of the adhesive applying member 10 provide adhesive receiving pockets, and the channels 24 and 26 provide a means whereby surplus adhesive may readily drain away from the V-shaped grooves 20 if the adhesive fed to the grooves is not applied to the shoe bottom during the operation of a shoe machine embodying the present invention during operation upon a shoe. Thus, any buildup of adhesive, and consequential problems of damage to the upper, will be avoided in the event that some of the grooves are not covered by an insole during a cycle of operations of the machine.

Although the invention has been described with a certain degree of particularity, it is susceptible to modifications such as the array or cross-sectional shape of the grooves 20, or channels 24 and 26 being of different cross section to what was described, or the grooves 20 may be replaced by dimples, or the channels 24 and 26 may be inclined on several planes. Therefore, the claims following are interpretive only and not in a limiting sense.

What we desire to claim by United States letters Patent is:

1. A shoe machine having an adhesive applying arrangement comprising:

an adhesive applying member having a generally U-shaped shoe bottom confronting surface having end regions provided with a plurality of generally V-shaped grooves in said surface extending generally lengthwise with respect to a shoe disposed therewith;

said V-shaped grooves having a network of openings therein through which molten adhesive is extruded;

said V-shaped grooves in said surface being interrupted by generally crosswise extending channels, said channels being disposed deeper in said surface than said V-shaped grooves; and said V-shaped grooves being separated from one another by another array of channels extending generally lengthwise of said adhesive applying member, whereby surplus adhesive may be drawn away from the V-shaped grooves into either channel arrangement.

2. A shoe machine having an adhesive applying member as recited in claim 1, wherein said regions comprise machined blocks;

each of said blocks having a recessed portion on its underside and passageways extending from said recess to said V-shaped grooves;

said recess and said passageway permitting the flow of adhesive therethrough to be extruded in said V-shaped grooves to be applied to a shoe bottom confronted thereon.

3. A shoe machine having an adhesive applying member as recited in claim 2 wherein said blocks are clamped to an adhesive applying member by an arrangement of bolts therethrough.

4. A shoe machine having an adhesive applying member as recited in claim 2 wherein said generally U-shaped shoe bottom confronting surface is arranged to confront the toe end and associated marginal portions of a shoe bottom.

5. A shoe machine having an adhesive applying member as recited in claim 2 wherein said generally U-shaped shoe bottom confronting surface is arranged to confront the heel end and associated marginal portions of a shoe bottom.

* * * * *